US008739970B2

(12) United States Patent
Kagen

(10) Patent No.: US 8,739,970 B2
(45) Date of Patent: Jun. 3, 2014

(54) GOLF BAG WITH MECHANISM TO SECURE CLUBS

(76) Inventor: Alan M. Kagen, Pooler, GA (US)

( * ) Notice: Subject to any disclaimer, the term of this patent is extended or adjusted under 35 U.S.C. 154(b) by 29 days.

(21) Appl. No.: 13/461,226

(22) Filed: May 1, 2012

(65) Prior Publication Data

US 2012/0211381 A1 Aug. 23, 2012

Related U.S. Application Data

(63) Continuation of application No. 12/820,238, filed on Jun. 22, 2010, now Pat. No. 8,186,507, which is a continuation of application No. 12/044,449, filed on Mar. 7, 2008, now Pat. No. 7,775,353.

(60) Provisional application No. 60/893,406, filed on Mar. 7, 2007.

(51) Int. Cl.

| | |
|---|---|
| ***A63B 55/00*** | (2006.01) |
| *A63B 55/02* | (2006.01) |
| *A63B 55/04* | (2006.01) |

(52) U.S. Cl.

CPC ..... *A63B 55/00* (2013.01); *A63B 55/02* (2013.01); *A63B 55/008* (2013.01); *A63B 55/04* (2013.01)

USPC ..... 206/315.5; 206/315.1; 206/315.2; 206/315.3; 206/315.4; 206/315.6; 280/47.26; 280/652; 70/58

(58) Field of Classification Search

USPC ..... 206/316.1–315.6; 280/47.26, 652; 70/58

See application file for complete search history.

(56) References Cited

U.S. PATENT DOCUMENTS

| | | | | |
|---|---|---|---|---|
| 1,570,500 | A * | 1/1926 | Kennedy | 206/315.6 |
| 1,719,360 | A | 7/1929 | Deike | |
| 2,681,810 | A | 6/1954 | Lowinski | |
| 2,722,431 | A | 11/1955 | Victor | |
| 3,265,106 | A | 8/1966 | Jarman | |
| 4,148,496 | A | 4/1979 | Zimmer | |
| 4,753,446 | A | 6/1988 | Mills | |
| 4,834,235 | A | 5/1989 | Solheim et al. | |
| 5,029,703 | A | 7/1991 | Dulyea, Sr. | |
| 5,459,960 | A | 10/1995 | Manlove | |
| 5,469,960 | A * | 11/1995 | Yuill | 206/315.3 |
| 5,857,567 | A | 1/1999 | Cheng | |
| 6,006,904 | A | 12/1999 | Jacobsen | |
| 6,142,319 | A * | 11/2000 | Kim | 211/70.2 |
| 6,196,385 | B1 * | 3/2001 | Thompson et al. | 206/315.6 |
| 6,352,154 | B1 * | 3/2002 | Miura | 206/315.6 |
| 6,381,998 | B1 * | 5/2002 | Good | 70/58 |
| 6,464,076 | B2 * | 10/2002 | Tan | 206/315.6 |
| 6,862,906 | B2 | 3/2005 | Lindkjølen | |
| 7,025,202 | B2 * | 4/2006 | Jansen et al. | 206/315.3 |
| 7,281,398 | B1 * | 10/2007 | Sims | 70/58 |
| 7,775,353 | B2 * | 8/2010 | Kagen | 206/315.6 |
| 7,934,729 | B2 * | 5/2011 | Murphy et al. | 280/47.26 |
| 2001/0017272 | A1 | 8/2001 | Thompson et al. | |
| 2004/0113380 | A1 * | 6/2004 | Freedman | 280/47.26 |
| 2008/0011631 | A1 * | 1/2008 | Kim | 206/315.6 |

* cited by examiner

*Primary Examiner* — Fenn Mathew
*Assistant Examiner* — Cynthia Collado
(74) *Attorney, Agent, or Firm* — Nixon & Vanderhye P.C.

(57) ABSTRACT

A mechanism cooperable with the stand mechanism in a stand golf bag secures the clubs in position when the bag is not on the ground and releases the clubs when the bag is set on the ground.

8 Claims, 3 Drawing Sheets

GOLF BAG WITH MECHANISM TO SECURE CLUBS

CROSS-REFERENCES TO RELATED APPLICATIONS

This application is a continuation of U.S. patent application Ser. No. 12/820,238, filed Jun. 22, 2010, now U.S. Pat. No. 8,186,507, which is a continuation of U.S. patent application Ser. No. 12/044,449, filed Mar. 7, 2008, now U.S. Pat. No. 7,775,353, which claims the benefit of U.S. Provisional Patent Application Ser. No. 60/893,406, filed Mar. 7, 2007, the entire contents of each of which are hereby incorporated by reference in this application.

STATEMENT REGARDING FEDERALLY SPONSORED RESEARCH OR DEVELOPMENT (NOT APPLICABLE)

BACKGROUND OF THE INVENTION

Many golfers prefer walking while playing rather than riding in a golf cart. As such, stand bags have become popular, including a mechanism that extends stand legs when the bag is placed on the ground. See, for example, U.S. Pat. No. 5,857,567 and U.S. Pat. No. 4,834,235, the contents of which are hereby incorporated by reference. These bags typically also include a two-strap shoulder strap to facilitate carrying.

A problem arises, however, in that while walking, the clubs tend to bang into each other, which over time may cause damage to the club faces or grooves and at a minimum causes undesirable noise.

SUMMARY OF THE INVENTION

It would thus be desirable to provide a mechanism cooperable with the stand mechanism in a stand bag that secures the clubs in position when the bag is not on the ground and releases the clubs when the bag is set on the ground.

In an exemplary embodiment, a golf bag includes a main compartment with a plurality of sub-compartments, each sub-compartment being sized to receive at least one golf club, and a base unit affixed at a bottom of the main compartment and including a plurality of club end receptacles sized to receive a grip end of at least one golf club. A stand mechanism is cooperable with the main compartment and is configured to extend when the base unit is set on a surface and to retract when the base unit is lifted from the surface. A club lock mechanism is cooperable with the stand mechanism and includes an elastic member wound through each of the club end receptacles. The club lock mechanism is configured to expand the elastic member when the stand mechanism is extended and to contract the elastic member when the stand mechanism is retracted.

In another exemplary embodiment, a golf bag includes a stand mechanism that extends a stand when the bag is set on a surface and retracts the stand when the bag is lifted from the surface, and a club lock mechanism cooperable with the stand mechanism that secures golf clubs stored in the golf bag in position when the bag is not on the surface and releases the golf clubs when the bag is set on the surface.

DETAILED DESCRIPTION OF THE INVENTION

Figure 1:
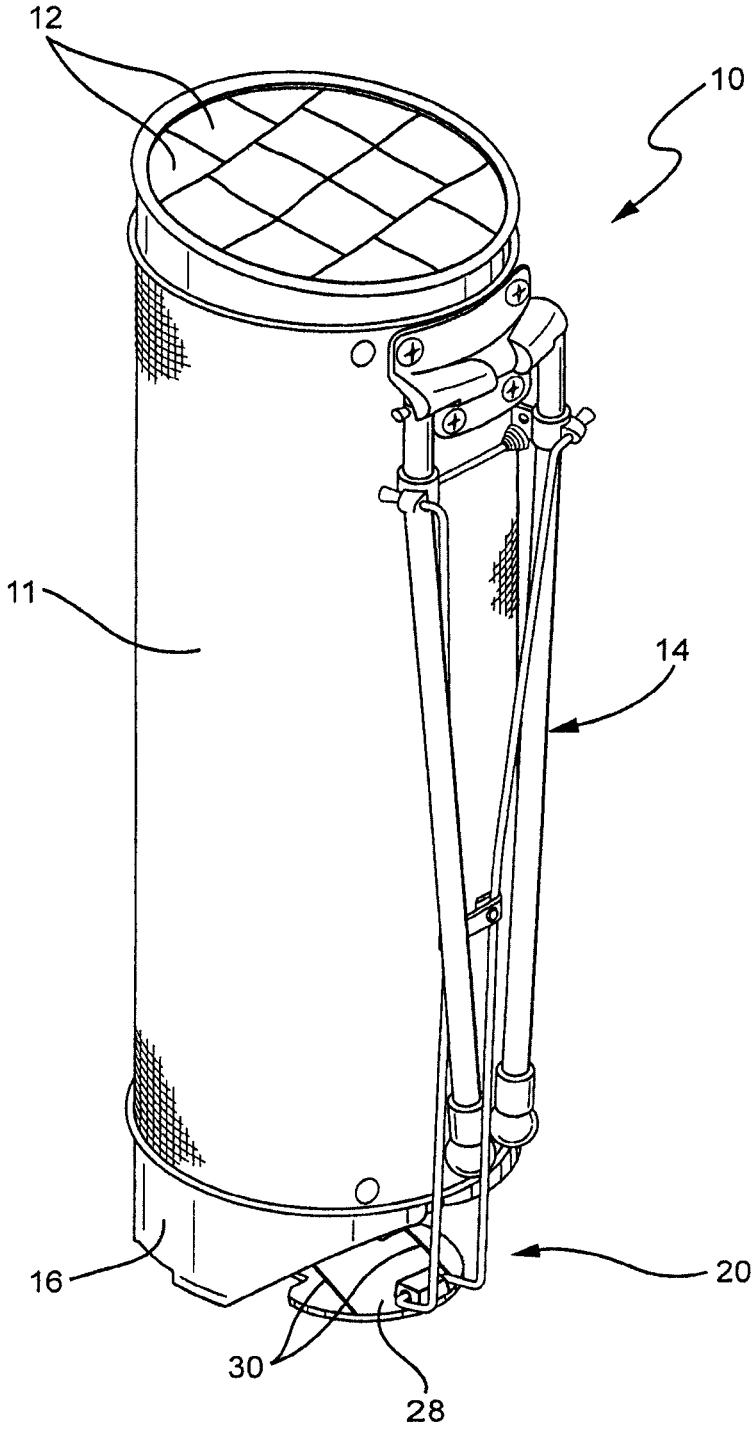
FIGS. 1 and 2 show a golf bag including an exemplary stand mechanism with supporting legs.
Figure 2:
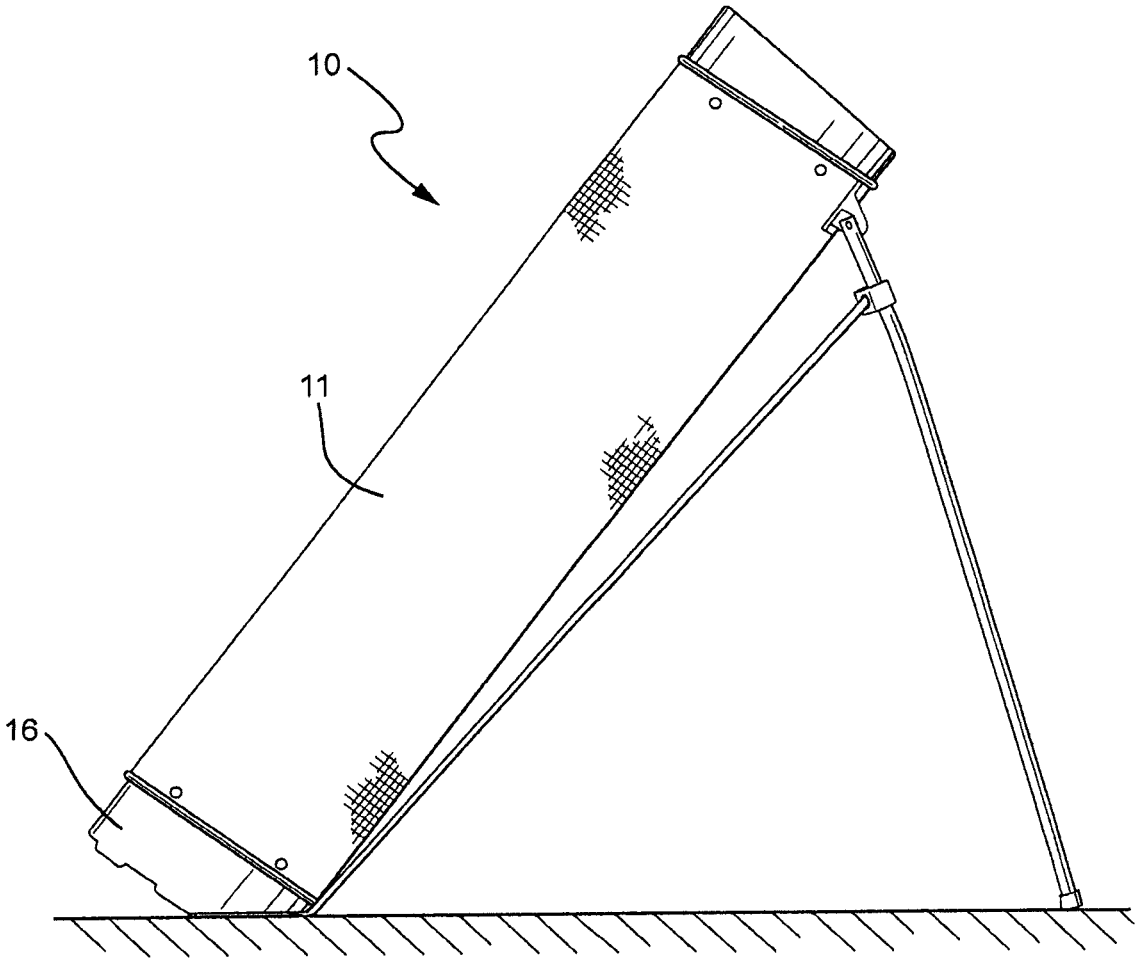

FIGS. 1 and 2 show a golf bag including an exemplary stand mechanism with a pair of supporting legs 14 in a retracted position in FIG. 1 and an extended position in FIG. 2. The bag 10 generally comprises a tubular main compartment 11 divided by dividers into a plurality of sub-compartments 12, where each sub-compartment 12 is sized to receive at least one golf club. As shown in FIG. 1, a sub-compartment 12 is provided for each of the fourteen clubs typically carried by golfers.

Figure 3:
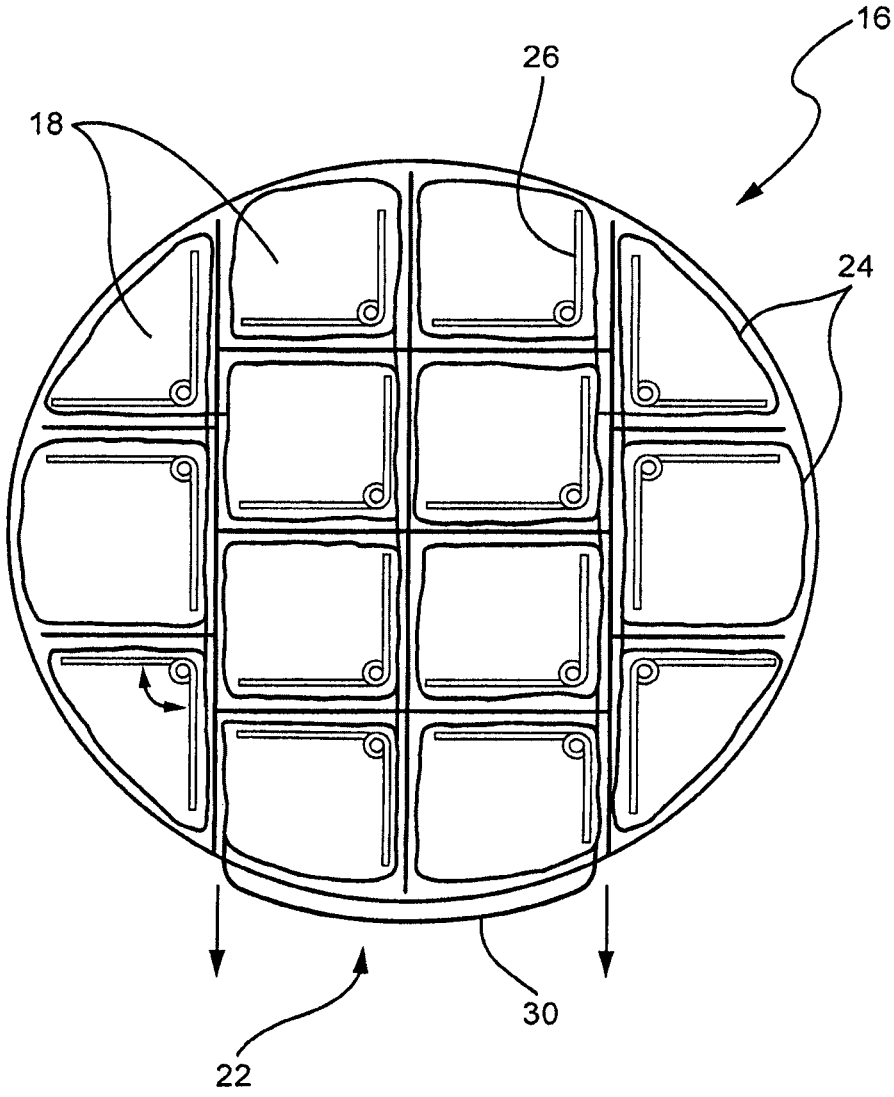
FIG. 3 shows an exemplary base unit and club lock assembly.

A base unit 16 is affixed at a bottom of the main compartment 11. With reference to FIG. 3, the base unit 16 includes a plurality of club end receptacles 18 disposed at a bottom end of each sub-compartment 12. The club end receptacles 18 are sized to receive a grip end of at least one golf club.

A stand mechanism 20 is cooperable with the main compartment 11 and is configured to extend the stand legs 14 when the base unit 16 is set on a surface and to retract the stand legs 14 when the base unit is lifted from the surface. The stand mechanism 20 is biased toward the retracted position so that when the bag 10 is lifted off the ground, a biasing mechanism automatically pulls the stand legs 14 to their retracted position (shown in FIG. 1). Any suitable activating mechanism may be used as would be apparent to those of ordinary skill in the art. Many such mechanism are known, and further details thereof will not be described.

With reference to FIG. 3, the base unit 16 includes a club lock mechanism 22 cooperable with the stand mechanism 20. In a preferred arrangement, the club lock mechanism 22 includes an elastic member 24 such as a strap or the like that is weaved in and around a plurality of leaf springs 26, one each disposed in each of the club end receptacles 18. The leaf springs 26 are biased open to thereby press the elastic member 24 against walls of the club end receptacles 18. In this context, when the stand mechanism 20 is extended, an activating member 28 of the stand mechanism 20 is pushed against the base unit 16 as shown in FIG. 2 to thereby expand the elastic member 24 and set the club lock mechanism 22 in an open position. In this position, with the stand mechanism extended, golf clubs set in the club end receptacles 18 can be easily inserted and removed.

When the bag is picked up, a biasing component of the stand mechanism 20 retracts the stand legs 14 and extends the activating member 28 to thereby extend/stretch the elastic member 24 via leads 30, which serves to contract the leaf springs 26 into gentle engagement with ends of the golf clubs. In this state as shown in FIG. 1, the clubs are secured in the club end receptacles 18 and are prevented from banging against each other while the user is walking with the bag.

Those of ordinary skill in the art will appreciate that alternative mechanisms may be used for securing and releasing the clubs in conjunction with extension and retraction of the stand legs, and the invention is not necessarily meant to be limited to the exemplary configuration illustrated in FIG. 3. For example, alternative configurations may include cylindrical openings or members that contract when the stand legs are retracted and that open when the stand legs are extended. Alternatively, an insert may be provided flush with a sidewall of the sub-compartments 12 or club end receptacles 18 when the stand legs are in the extended position, which insert may be deflected to contract the sub-compartments 12 for club end receptacles 18 when the stand legs are retracted.

Similar concepts may be applicable to a golf bag that does not include individual sub-compartments for each club as shown in FIG. 3. For example, the bag may include only three sub-compartments capable of receiving multiple clubs. In this instance, a larger mechanism for each compartment may be activated/contracted or deactivated/extended in conjunction with the stand mechanism to secure and release the clubs when the bag is picked up or when the bag is set on the stand mechanism, respectively.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A golf bag comprising:

a bag component;

a club lock mechanism cooperable with the bag component and dependent on a position of the bag component, the club lock mechanism being brought into an engagement position in which the club lock mechanism engages golf clubs stored in the golf bag to secure the golf clubs in position when the bag component is displaced to a first position, and the club lock mechanism being brought into a release position in which the club lock mechanism releases engagement of the golf clubs when the bag component is displaced to a second position; and a spring acting between the bag component and the club lock mechanism, wherein the club lock mechanism is displaced between the release position and the engagement position at least partly by the spring.

2. A golf bag comprising:

a bag component displaceable between a first position and a second position;

a club lock mechanism cooperable with the bag component and dependent on a position of the bag component, the club lock mechanism including retaining members displaceable between an engagement position in which the retaining members are brought from a position not engageable with golf clubs in the golf bag into a position engageable with the golf clubs in the golf bag, and a release position in which the retaining members are displaced from the position engageable with the golf clubs in the golf bag to the position not engageable with the golf clubs in the golf bag, wherein the retaining members are displaced to the release position when the bag component is in the first position, and wherein the retaining members are displaced to the engagement position when the bag component is in the second position; and a spring acting between the bag component and the club lock mechanism, wherein the club lock mechanism is displaced between the release position and the engagement position at least partly by the spring.

3. A golf bag according to claim 2, wherein the retaining members comprise leaf springs.

4. A golf bag according to claim 3, wherein the club lock mechanism further comprises an elastic member coupled directly to the bag component, the elastic member contracting the leaf springs into the position engageable with the golf clubs when the bag component is in the second position.

5. A golf bag according to claim 1, wherein the bag component comprises a stand mechanism.

6. A golf bag according to claim 1, wherein the bag component is attached to the golf bag.

7. A golf bag according to claim 2, wherein the bag component comprises a stand mechanism.

8. A golf bag according to claim 2, wherein the bag component is attached to the golf bag.

* * * * *